US006302486B1

(12) United States Patent
Lamart et al.

(10) Patent No.: US 6,302,486 B1
(45) **Date of Patent: *Oct. 16, 2001**

(54) SEATING UNIT WITH ADJUSTABLE ARMREST

(75) Inventors: Michel A. Lamart, Kentwood; Arnold B. Dammermann, Grand Rapids; Glenn A. Knoblock, Kentwood; Robert S. Grooters, Grand Rapids; Larry DeKraker, Holland; John Hanna J. Hasbany, Grand Rapids, all of MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/677,351

(22) Filed: Oct. 2, 2000

Related U.S. Application Data

(63) Continuation of application No. 09/545,262, filed on Apr. 7, 2000, now Pat. No. 6,176,550, which is a continuation of application No. 09/356,195, filed on Jul. 16, 1999, now Pat. No. 6,168,237, which is a continuation of application No. 08/984,582, filed on Dec. 3, 1997, now Pat. No. 5,971,484.

(51) Int. Cl.[7] ..... A47C 7/54

(52) U.S. Cl. ..... 297/411.37; 297/411.35

(58) Field of Search ..... 297/411.35, 411.37, 297/411.38; 403/97, 298; 248/118, 118.1, 118.5

(56) References Cited

U.S. PATENT DOCUMENTS

| | | |
|---|---|---|
| D. 329,770 | 9/1992 | Grahl et al. . |
| D. 371,474 | 7/1996 | Koopman . |
| 455,168 | 6/1891 | Case . |
| 461,928 | 10/1891 | White . |

(List continued on next page.)

FOREIGN PATENT DOCUMENTS

| | | | |
|---|---|---|---|
| 1315186 | 3/1993 | (CA) . | |
| 1496182 | 8/1967 | (FR) | 403/298 |
| 1564568 | 3/1969 | (FR) | 403/298 |
| 2505158 | 11/1982 | (FR) | 297/411.37 |
| 2702806 | 9/1994 | (FR) | 403/97 |
| 2255277 | 11/1992 | (GB) . | |
| WO9639903 | 12/1996 | (WO) . | |

*Primary Examiner*—Peter R. Brown
(74) *Attorney, Agent, or Firm*—Price, Heneveld, Cooper, DeWitt & Litton

(57) ABSTRACT

An armrest construction for chairs includes an armrest support having a lower end constructed for attachment to a chair, an upper end, and a mounting block attached to the upper end. A pivot block is pivoted to the mounting block at a main pivot, the pivot block having an upwardly-extending follower. First and second gears are each pivoted to the pivot block, the gears having intermeshing teeth at an inner end such that rotation of the first gear causes the second gear to simultaneously rotate in an opposite direction, the first and second gears further having outer ends. A support plate having pivot/slide members engages the outer ends of the first and second gears, and further has a guide operably engaging the follower to guide lateral movement of the support plate along a predetermined path. The support plate is rotatable about the main pivot to adjust the angular orientation of the armrest construction and is laterally movable along continuously parallel positions to adjust a width of the armrest construction relative to the chair. The armrest construction is mounted on a vertically-adjustable armrest support member for optimal adjustability.

49 Claims, 8 Drawing Sheets

U.S. PATENT DOCUMENTS

| | | |
|---|---|---|
| 1,407,174 | 2/1922 | Simpson . |
| 1,706,634 | 3/1929 | Seils . |
| 2,549,902 | 4/1951 | Hibbard et al. . |
| 2,972,505 | 2/1961 | Weickgenannt . |
| 3,206,249 | 9/1965 | Gateley . |
| 3,784,149 | 1/1974 | Brudy . |
| 3,932,048 | 1/1976 | DuPont . |
| 4,018,370 | 4/1977 | Wood . |
| 4,085,967 | 4/1978 | Spencer . |
| 4,253,649 | 3/1981 | Hewson . |
| 4,277,102 | 7/1981 | Aaras et al. . |
| 4,576,351 | 3/1986 | Brink . |
| 4,785,190 | 11/1988 | Frankena . |
| 4,822,103 | 4/1989 | Stenvall . |
| 4,898,491 | 2/1990 | Van Steenburg . |
| 4,917,438 | 4/1990 | Morgan . |
| 4,961,610 | 10/1990 | Reeder et al. . |
| 5,056,863 | 10/1991 | DeKraker et al. . |
| 5,135,190 | 8/1992 | Wilson . |
| 5,143,422 | 9/1992 | Althofer et al. . |
| 5,188,423 | 2/1993 | Meiller et al. . |
| 5,190,390 | 3/1993 | Ming-Tai . |
| 5,215,282 | 6/1993 | Bonutti . |
| 5,281,001 | 1/1994 | Bergsten et al. . |
| 5,368,365 | 11/1994 | Feldberg . |
| 5,369,805 | 12/1994 | Bergsten et al. . |
| 5,380,065 | 1/1995 | Rohrer . |
| 5,382,079 | 1/1995 | Wilson et al. . |
| 5,393,124 | 2/1995 | Neil . |
| 5,407,249 | 4/1995 | Bonutti . |
| 5,415,459 | 5/1995 | Schultz . |
| 5,439,267 | 8/1995 | Peterson et al. . |
| 5,439,268 | 8/1995 | Dozsa-Farkas . |
| 5,484,187 | 1/1996 | Doerner et al. . |
| 5,536,070 | 7/1996 | Lemmen . |
| 5,590,934 | 1/1997 | Gibbs . |
| 5,597,207 | 1/1997 | Bergsten et al. . |
| 5,597,208 | 1/1997 | Bonutti . |
| 5,600,870 | 2/1997 | Fields et al. . |
| 5,641,203 | 6/1997 | Van De Riet et al. . |
| 5,651,586 | 7/1997 | Groth . |
| 5,655,814 | 8/1997 | Gibbs . |
| 5,667,277 | 9/1997 | Van De Riet . |
| 5,676,483 | 10/1997 | Koubek . |
| 5,752,683 | 5/1998 | Novis et al. . |
| 5,881,976 | 3/1999 | Breen et al. . |
| 5,975,640 | 11/1999 | Chen . |

SEATING UNIT WITH ADJUSTABLE ARMREST

CROSS-REFERENCES TO RELATED APPLICATIONS

This application is a continuation of U.S. application Ser. No. 09/545,262, filed Apr. 7 2000, now U.S. Pat. No. 6,176,550, issued Jan. 23, 2001, entitled ADJUSTABLE ARMREST FOR CHAIRS, which is a continuation of U.S. application Ser. No. 09/356,195, filed Jul. 16, 1999, now U.S. Pat. No. 6,168,237, issued Jan. 2, 2001, entitled ADJUSTABLE ARMREST FOR CHAIRS, which is a continuation of U.S. application Ser. No. 08/984,582, filed Dec. 3, 1997, now U.S. Pat. No. 5,971,484, issued Oct. 26, 1999, entitled ADJUSTABLE ARMREST FOR CHAIRS, the entire contents of each of which are hereby incorporated herein by reference.

BACKGROUND OF THE INVENTION

The present invention concerns adjustable armrests for chairs that can be adjusted in multiple directions and orientations relative to a seated user for increased comfort and ergonomics.

Adjustable armrests allow users to comfortably support their forearms while working, despite the differences in their sizes, shapes, and preferences. This can be particularly important for computer operators and for people having desk jobs, where the person may stay seated for long periods of time, and where different users use the same chair. It is also important for users that are physically large or heavy, or that are physically small or light in weight, to be able to adjust the armrest to a lateral position that is both comfortably close to them, but far enough out of the way to not restrict their body movements in the chair. The amount of adjustment must be relatively large in order to accommodate as many users as possible. However, a large range of adjustment often causes present armrest adjustment mechanisms to become sloppy at their outermost extended positions, and/or reduces their durability because of the increased torsional forces that they encounter.

Sometimes, in an effort to make highly-adjustable armrests more secure, complicated latching and securing mechanisms are added. However, such parts are expensive, often complex, and are not easy to operate. Further, sometimes it is not intuitively obvious how latches and triggers operate, such that users new to the chair must undesirably spend time figuring out how to operate the armrest in order to adjust it. Also, multi-part mechanisms can lead to quality problems during manufacture and warranty problems in service.

To summarize, modern users demand armrests that are simple and easy to operate, that are intuitively obvious to adjust, and that have a good, solid feel during adjustment. At the same time, customers want long life and low cost. Accordingly, an armrest construction solving the aforementioned problems and having the aforementioned advantages is desired.

SUMMARY OF THE INVENTION

In one aspect of the present invention, an armrest construction for chairs includes an armrest support having a lower end constructed for attachment to a chair, an upper end, and a mounting block attached to the upper end. A pivot block is pivoted to the mounting block at a main pivot, the pivot block having an upwardly-extending follower. First and second gears are each pivoted to the pivot block, the gears having intermeshing teeth at an inner end such that rotation of the first gear causes the second gear to simultaneously rotate in an opposite direction, the first and second gears further having outer ends. A support plate has pivot/slide members engaging the outer ends of the first and second gears, and further has a guide operably engaging the follower to guide lateral movement of the support plate along a predetermined path. The support plate is rotatable about the main pivot to adjust the angular orientation of the armrest construction and is laterally movable along continuously parallel positions to adjust a width of the armrest construction relative to the chair.

In another aspect, an armrest construction for chairs includes an armrest support having an upper end and a pivot block attached to the upper end, the pivot block having a follower. First and second gears are each pivoted to the pivot block, the gears having intermeshing teeth at an inner end such that rotation of the first gear causes the second gear to simultaneously rotate in an opposite direction, the first and second gears further having outer ends. A support plate has pivot/slide members engaging the outer ends of the first and second gears, and further has a guide engaging the follower to guide lateral movement of the support plate along a predetermined path so that the support plate is laterally movable along continuously parallel positions to adjust a width of the armrest construction relative to the chair.

In another aspect, an armrest construction for chairs includes an elongated support having an upper end and a mounting block thereon, an armrest including a pivot block, and a main pivot pivotally interconnecting the mounting block to the pivot block. The main pivot includes a pivot hole in one of the mounting block and the pivot block, and includes a protrusion on the other of the mounting block and the pivot block for rotatably engaging the hole. The pivot hole and the protrusion include interfacing surfaces having a predetermined high coefficient of friction, such that rotation of the armrest about the main pivot requires a predetermined amount of force. In a preferred form, one of the interfacing surfaces is formed by a ribbed rubber element that causes the main pivot to move with a detented movement.

In another aspect, an armrest construction for chairs includes an elongated support including a mounting block, an armrest including a pivot block, and a main pivot pivotally interconnecting the mounting block to the armrest. A brake pad is located between the mounting block and the pivot block, the brake pad being spaced from the main pivot so that the armrest is rotatable about the main pivot, but so that a predetermined minimum torsional force is required sufficient to overcome a frictional force of the brake pad.

DETAILED DESCRIPTION OF THE PREFERRED EMBODIMENT

Figure 1:
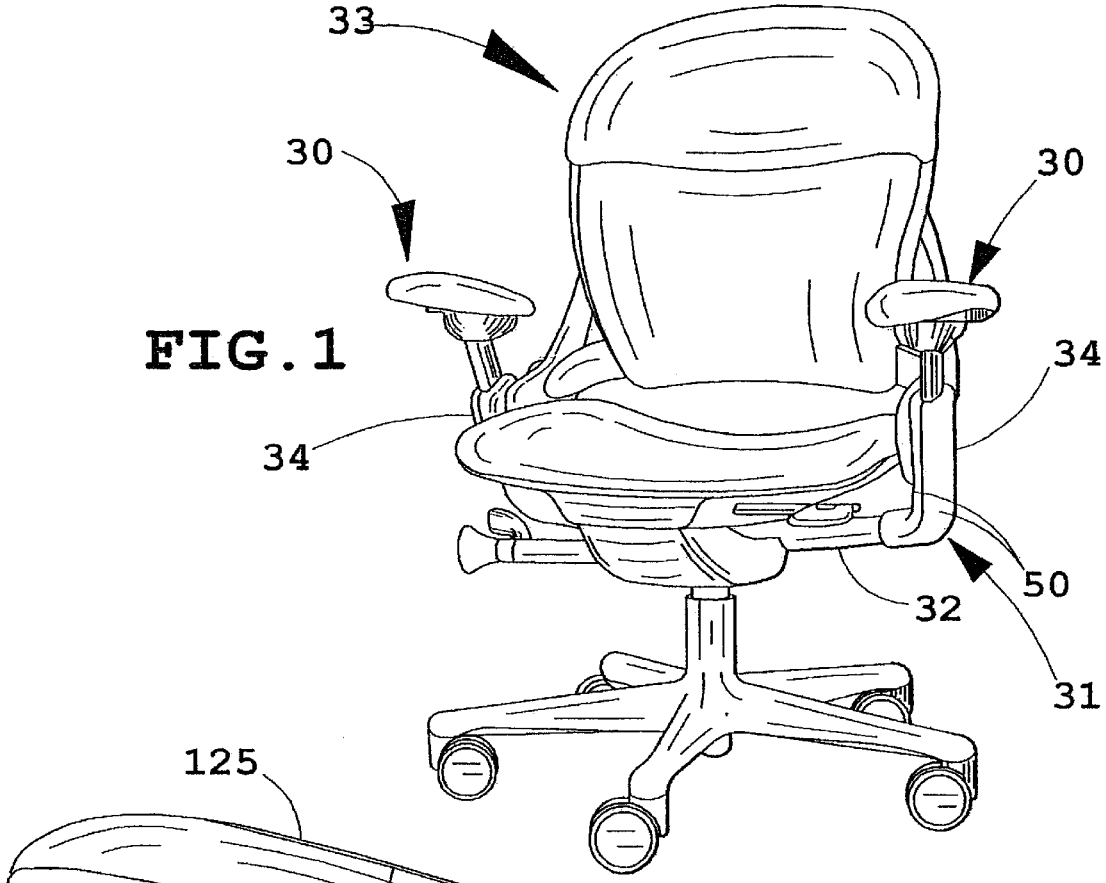
FIG. 1 is a perspective view of a chair including an armrest construction embodying the present invention.
Figure 2:
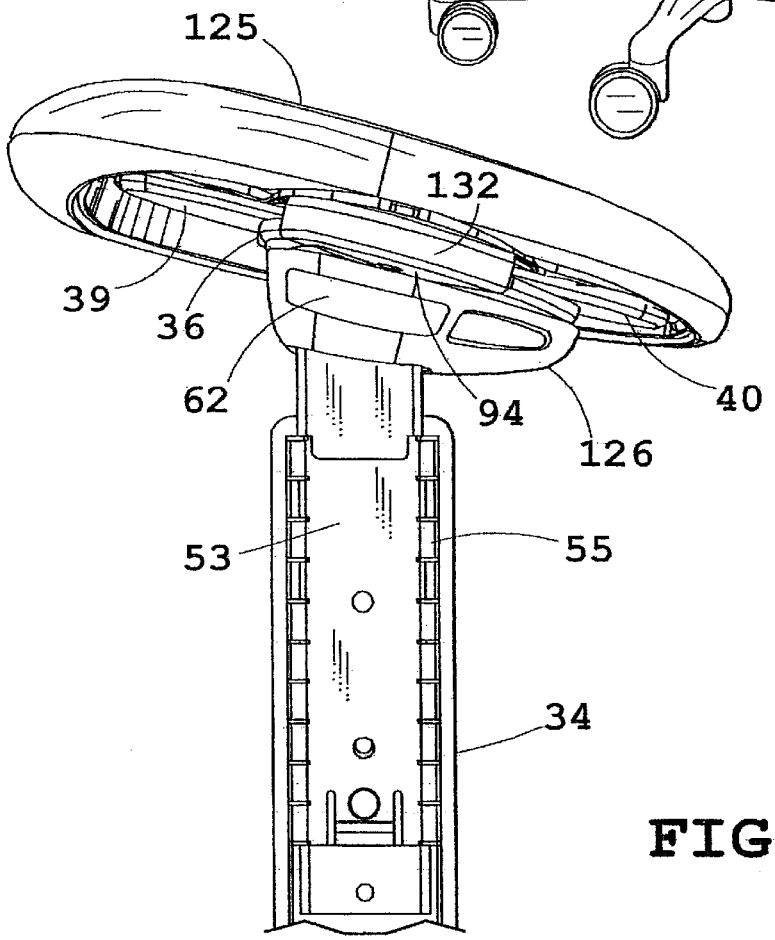
FIG. 2 is a side view of the armrest of FIG. 1.
Figure 4:
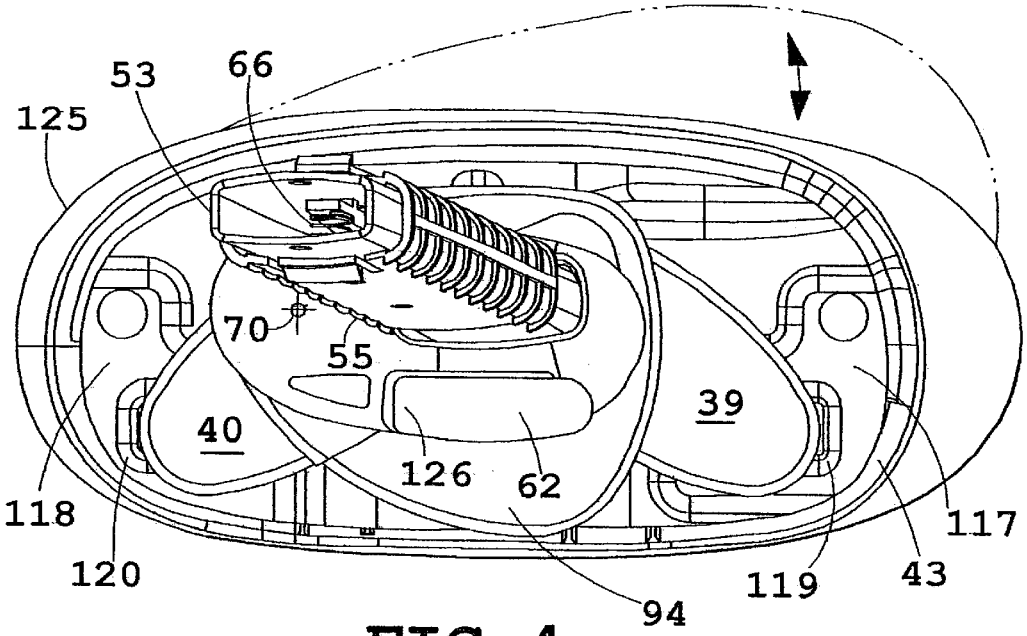
FIG. 4–6 are bottom views of the armrest construction of FIG. 2, FIGS. 4–6 showing the armrest adjusted to outboard, inboard, and intermediate parallel laterally-adjusted positions.
Figure 5:
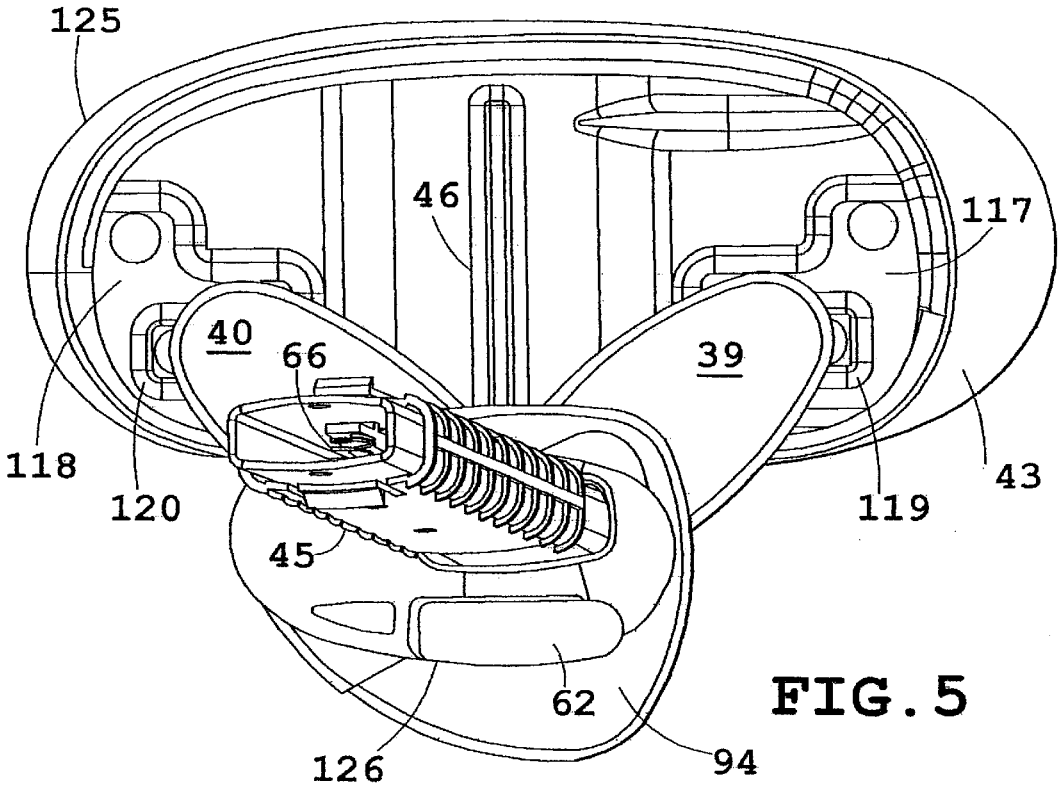
Figure 6:
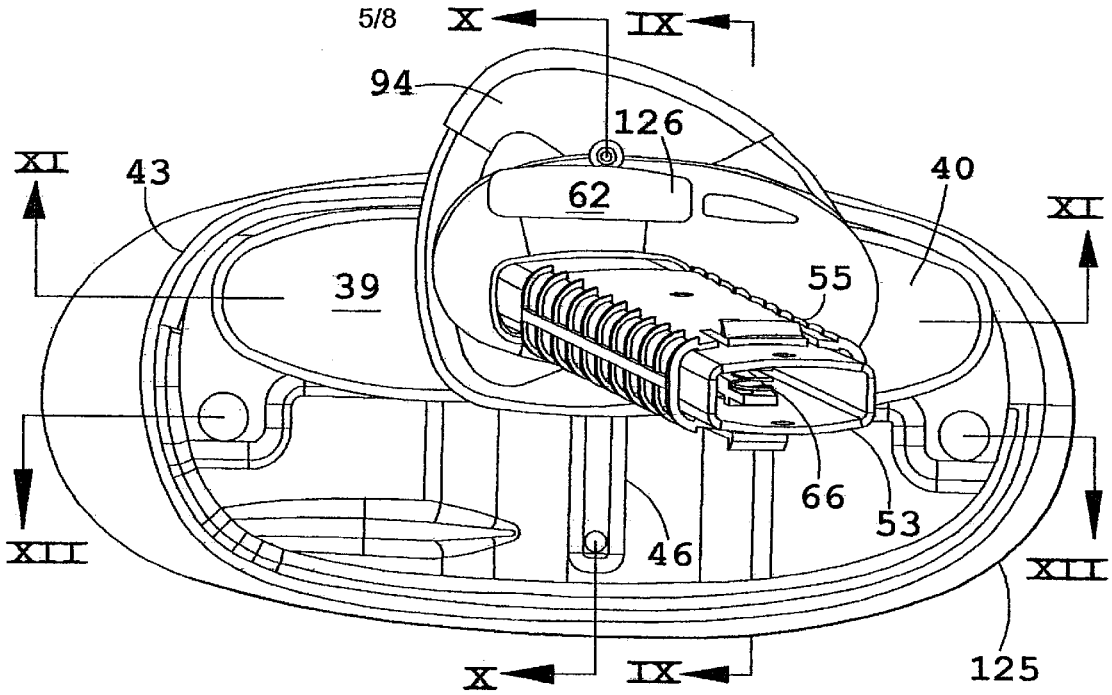
Figure 7:
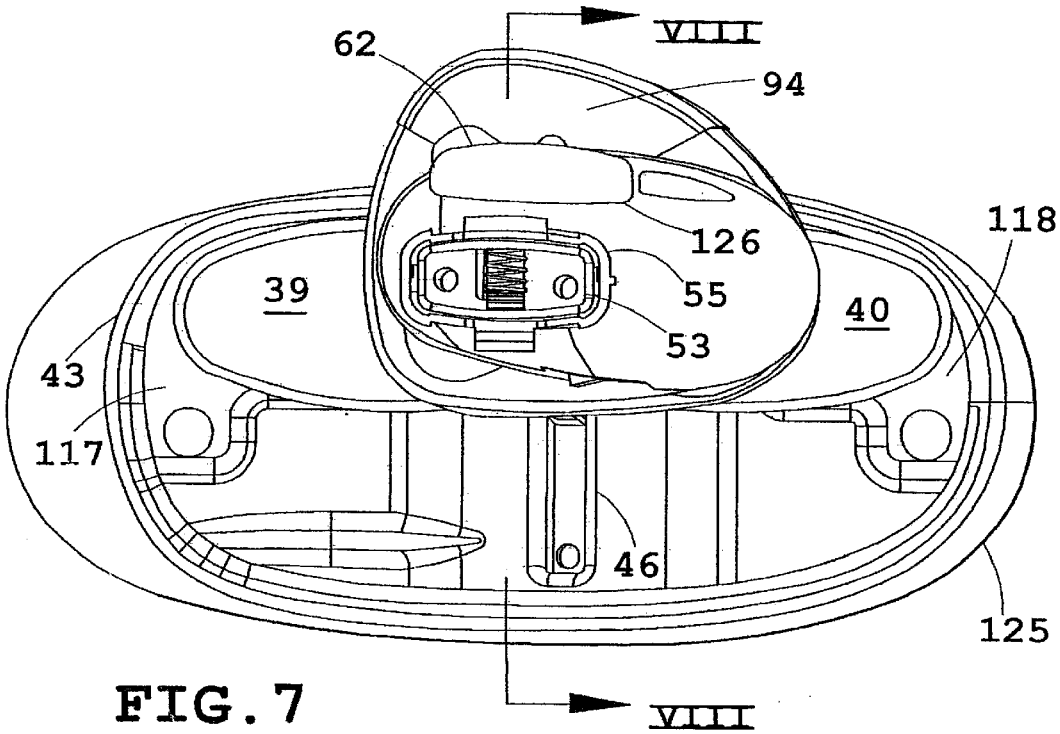
FIG. 7 is a bottom view of the armrest like FIG. 6, but taken from a bottom position aligned with the armrest support tube.

An armrest construction 30 (FIG. 1) embodying the present invention includes an armrest support 31 having a lower end 32 constructed for attachment to a chair 33, and an upper end 34. A mounting block 35 (FIG. 3A) is attached to the upper end. A pivot block 36 is pivoted to the mounting block 35 at a main pivot 37, the pivot block 36 having an upwardly-extending follower 38. Gears 39 and 40 (FIG. 3B) with intermeshing teeth 41 and 42 at their inner ends are pivoted to the pivot block 36 so that rotation of one gear causes the other gear to simultaneously rotate in an opposite direction. A support plate 43 has slots for receiving pivot/slide members 44 and 45 that pivotally engage the outer ends of the gears 39 and 40, and further has a guide channel 46 that operably engages the follower 38 to guide lateral movement of the support plate 43 along a predetermined lateral path relative to the chair 33. An armrest cushioned body 47 is attached to the support plate 43. By selectively adjusting the armrest body 47 and support plate 43, the armrest is angularly rotatable/adjustable about the main pivot 37 (FIG. 4) and is laterally translatable/adjustable along continuously parallel positions (FIGS. 4–6). Thus, the orientation and relative width of the armrest construction is adjustable relative to the chair.

Figure 3A:
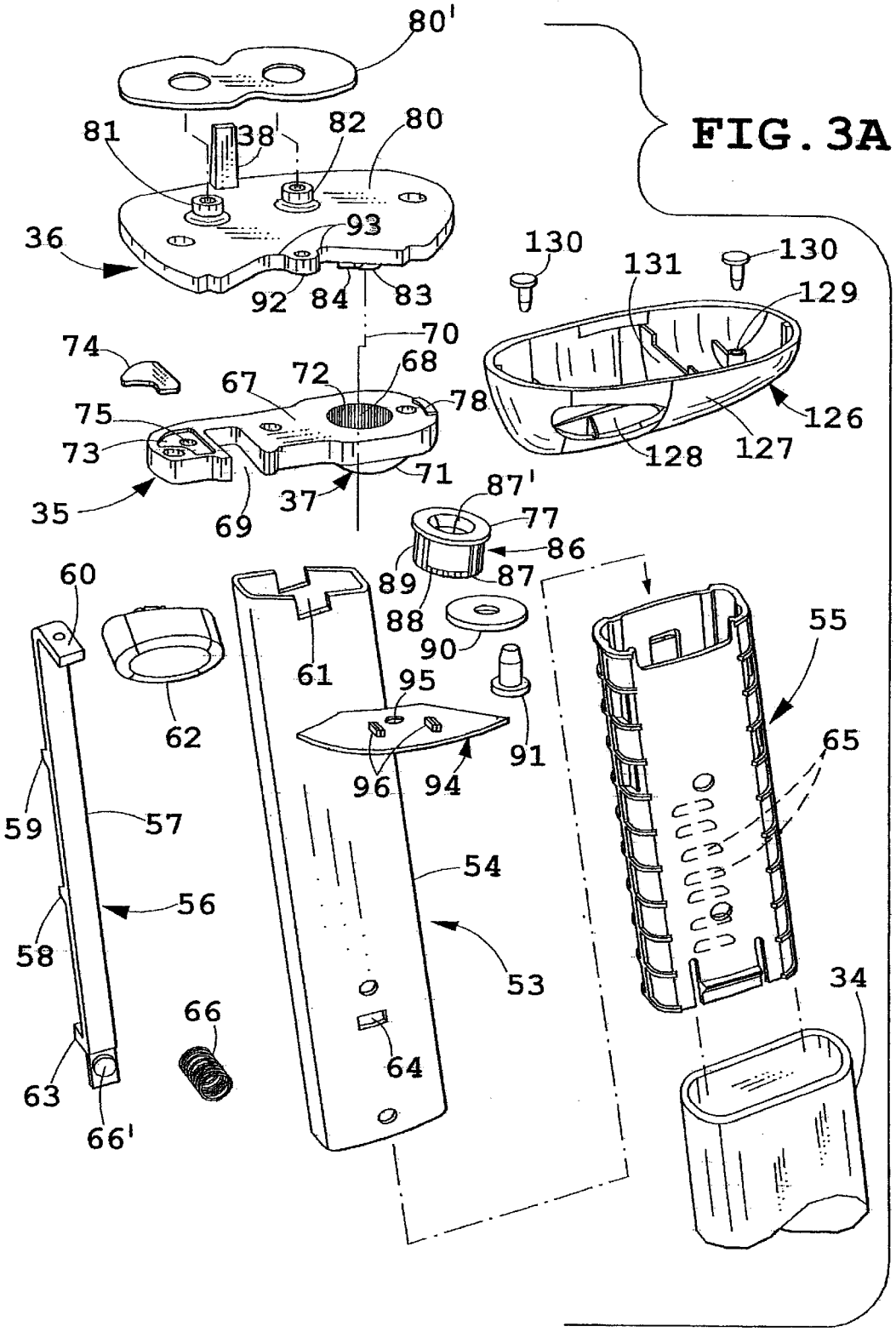
FIG. 3A and 3B are exploded perspective views of the armrest construction of FIG. 2.

The support 31 (FIG. 1) comprises an L-shaped structural member having the horizontal bottom or lower section 32 adapted for connection to a chair base under a chair seat and having a vertically-extending, tubular-top section 34 (FIG. 3A). A sleeve bushing 55 fits matingly into the top section 34, and includes frictional snap-lock detents for holding it therein. A tube weldment 53 includes a mating tube section 54 shaped to telescopingly slidingly engage an inside of the sleeve bushing 55 for telescoping height adjustment. A Z-shaped activator 56 fits operably within the tube section 54. The Z-shaped activator 56 includes a straight section forming a vertical lever 57. Lever 57 has a primary fulcrum pivot bump 58 located about its mid-point and a stop or bump 59 located somewhat thereabove. Notably, the location and size of fulcrum bumps 58 and 59 can be changed to optimize the function of actuator 56. A trigger-engaging top leg 60 extends through a notch 61 in a top of tube section 54, and a trigger/handle 62 is supported on top leg 60. There is a notch 61 in both sides of the tube section 54 so that the same tube section 54 can be used on either side of the chair. A bottom leg 63 of the activator 56 extends through a locator hole 64 and selectively into a series of vertically-spaced latching holes 65 in the tube section 54. One of the top and bottom legs 60 and 62 help locate the actuator 56 on the tube weldment 53 through the mating engagement of notch 61 and hole 64. A spring 66 sets on locator protrusion 66_and biases the activator 56 to an engaged position. The spring 66 can be a coil spring, a leaf spring, or other biasing means. The activator 56 pivots on the primary pivot bump 58 between engaged and disengaged positions of bottom leg 63, with secondary stop 59 acting to limit the pivoting motion of activator 56 during movement to the disengaged position by changing the fulcrum point when activator 56 is fully disengaged. A skirt cover formed by a polyvinyl chloride (PVC) cover or covers 50 (FIG. 1) are attached around the tubes 52 and 54 to protect and aesthetically cover the arm support assembly.

The mounting block 35 (FIG. 3A) is welded to an upper end of the tube section 54. Mounting block 35 comprises a plate 67 with a pivot hole 68 in one end and a notch 69 in its other end facing toward an outside of the chair. The pivot hole 68 defines an axis of rotation 70. A cylindrical flange 71 extends downwardly from mounting block 35 for extending/lengthening the effective length of the hole 68 to about triple the thickness of the plate 67. The cylindrical inner surface of the pivot hole 68 includes a series of axially-extending detent ridges 72. Notch 69 aligns with notch 61 in top tube section 54 for receiving the top leg 60. A recess 73 is formed in the notched end at a location spaced from pivot hole 68 for receiving a brake shoe 74. The brake shoe 74 comprises a rubber friction pad made of a high-friction material adapted to frictionally engage the pivot block 36 with a known and relatively high coefficient of friction, as described below. The brake shoe 74 is held in position by an adhesive or by a retention stud that extends through hole 75 in the recess 73. Mounting block 35 further includes holes and features as needed for assembly.

A flat flange 77 on pivot bushing 86 (described below) spaces the pivot block 36 above mounting block 35 and prevents metal-on-metal contact. A standoff 78 at the tip of the end opposite the brake shoe 74 also engages the pivot block 36 at a location spaced from the brake shoe 74 causing the pivot block 36 to engage the brake shoe 74 in a more uniform manner.

The pivot block 36 comprises a relatively flat steel plate 80 (FIG. 3A). A pair of upstanding apertured pivot-forming bosses 81 and 82 are formed in an intermediate section of the pivot block 36, and the upstanding finger or follower 38 is located along an outboard edge of the pivot block 36 generally at a location centered fore-to-aft relative to the two bosses 81 and 82. A spacer 80_is placed on flat plate 80 and is used as an interface between the pivot block and the gears 39 and 40 to avoid steel-on-steel contact. The spacer 80_is made from a rubber or friction-generating material to provide anti-slip engagement, such as when a seated user presses downwardly on the armrest. The material and function of spacer 80_are similar to that of brake shoe 74, although the materials do not need to be the same per se.

A protrusion 83 extends downwardly from one end of the pivot block 36. Protrusion 83 includes longitudinally-extending ridges 84 and an axially-aligned hole in its end. A main pivot bushing 86 fits onto protrusion 83. Main pivot bushing 86 includes a structural sleeve 87 with an inner diameter and channels 87_shaped to mateably and non-rotatably engage ridges 84. The outer surface of the bushing 86 is covered with a rubber coating or rubber element 88 that is rough and that includes a plurality of longitudinally-extending ridges 89. The ridges 89 frictionally and slidingly engage the ridges 72 on the hole 68 in mounting block 35, creating an interface that slips with a detented stop-and-start motion as the pivot block 36 is pivoted on the mounting block 35. A pivot washer 90 abuts a lower end of the pivot bushing 86 and a screw 91 extends through the washer 90 and threadably into the protrusion 83, thus securing the pivot block 36 to the mounting block 35. The pivot bushing 86 preferably has a washer-like top flange shaped to engage a top of the pivot block 36, where the top flange is sandwiched between the pivot block 36 and the mounting block 35 in a manner to better hold the pivot bushing 86 in the mounting block 35.

A laterally-extending planar tab 92 is formed along an inboard edge opposite follower 38. A concavity 93 is formed on each side of the tab 92. A lower cover plate 94 includes a hole 95 for receiving a threaded screw extended through hole 95 into the tab 92. The lower cover plate 94 includes flanges 96 that engage the concavities 93 to help hold the lower cover plate 94 in a predetermined angular position on the pivot block 36 for maximum covering effect. The lower cover plate 94 is welded or secured to cover 132, described below.

Gears 39 and 40 (FIG. 3B) include holes 97 and 98 for rotatably engaging the bosses 81 and 82, respectively. Teeth 41 and 42 are spaced from holes 97 and 98 so that they intermeshingly engage, causing the gears 39 and 40 to rotate simultaneously in opposing directions when one of the gears is forcibly rotated. Arcuate channels 99 and 99_, each having rough bottoms therein, are formed around each of holes 97 and 98 at locations opposite teeth 41 and 42. Upwardly-extending apertured, pivot-forming bosses 101 and 102 are formed at an end opposite the teeth 41 and 42 on each of gears 39 and 40, respectively.

Figure 8:
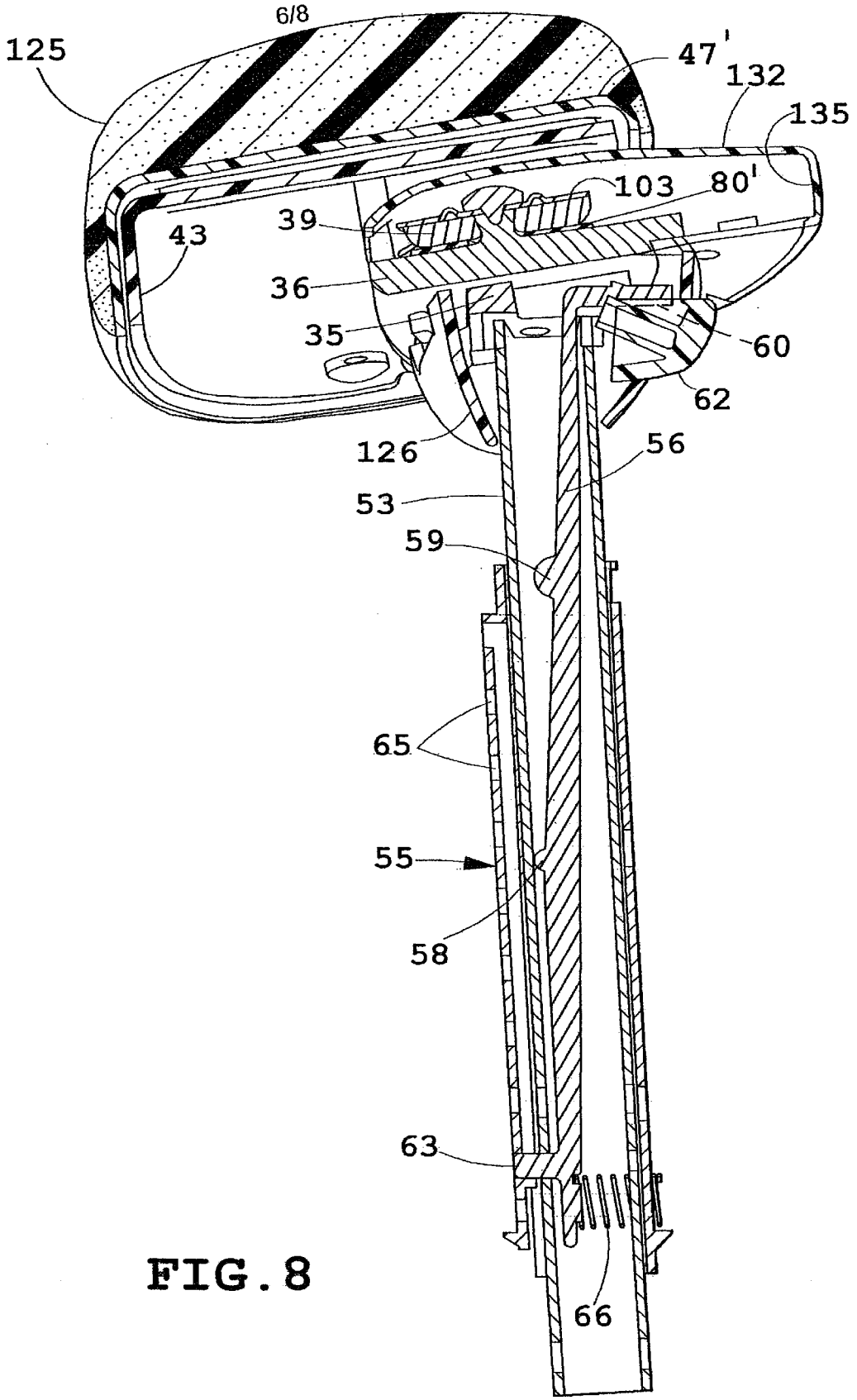
FIG. 8 is a cross-sectional view taken along the line VII—VII in FIG. 7.
Figure 9:
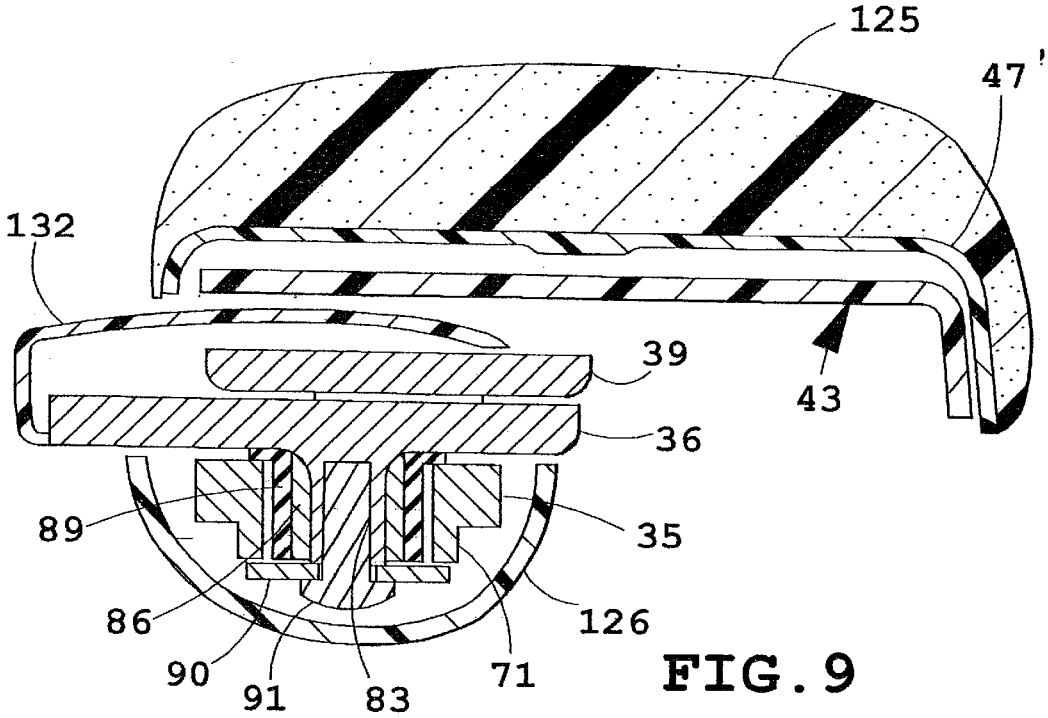
FIG. 9–12 are cross-sectional views taken along the lines IX—IX, X—X, XI—XI, and XII—XII in FIG. 6.
Figure 10:
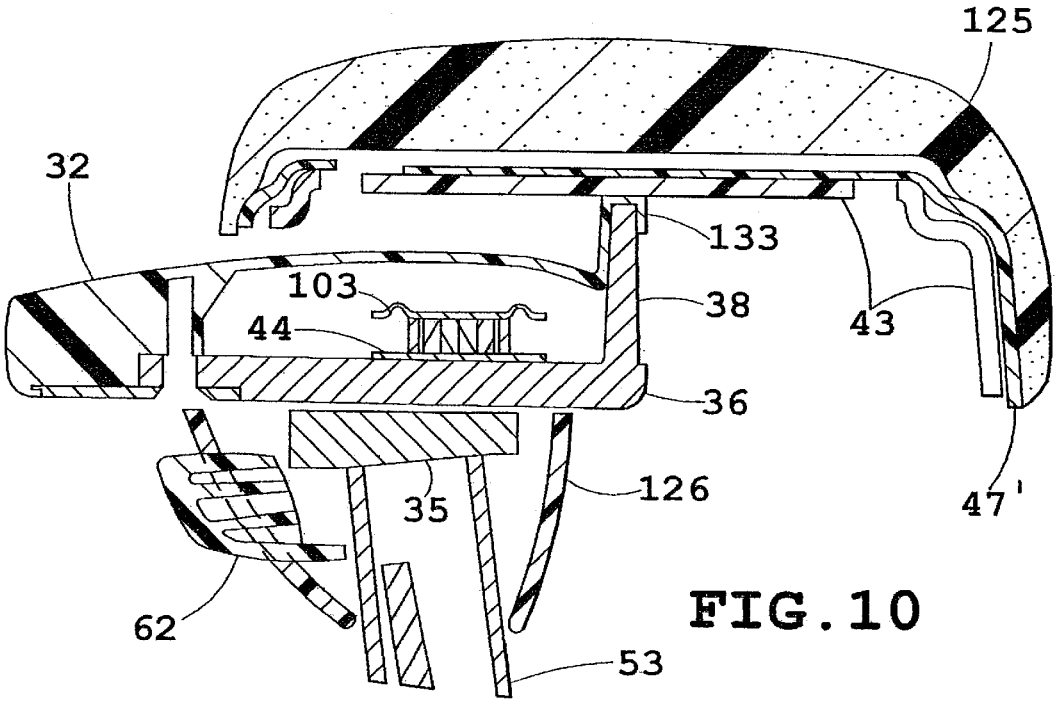
Figure 11:
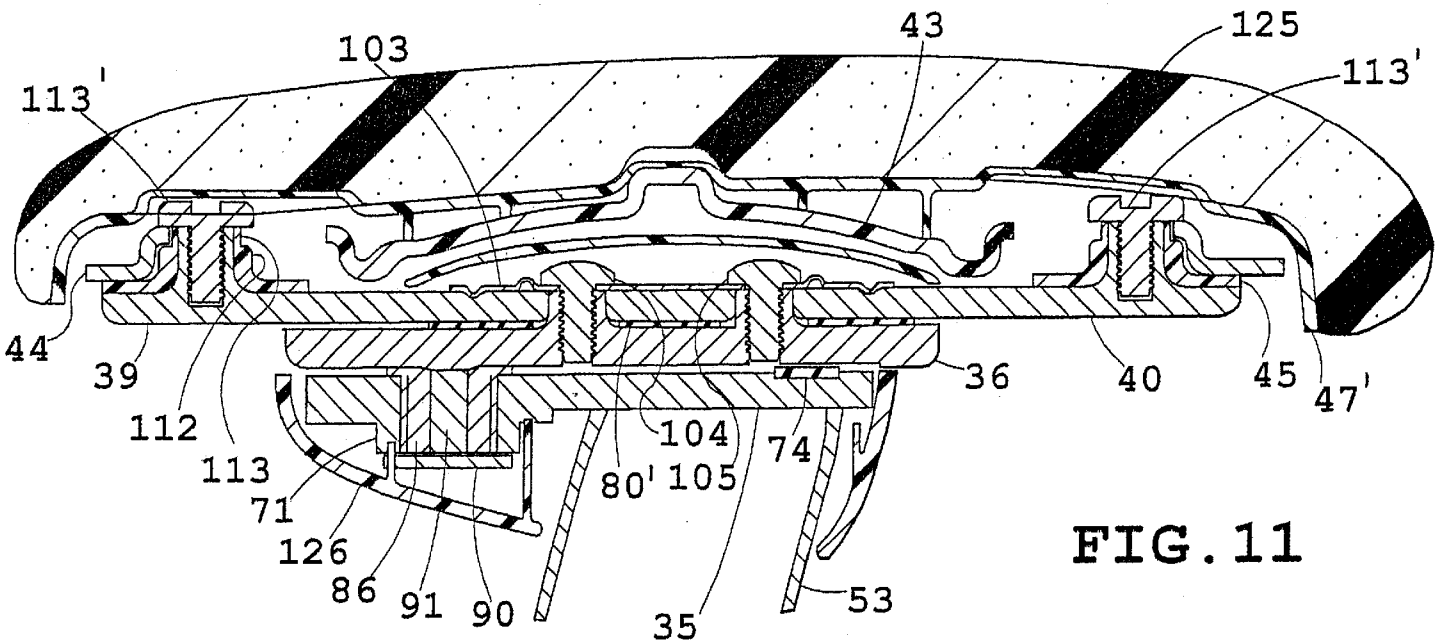
Figure 12:
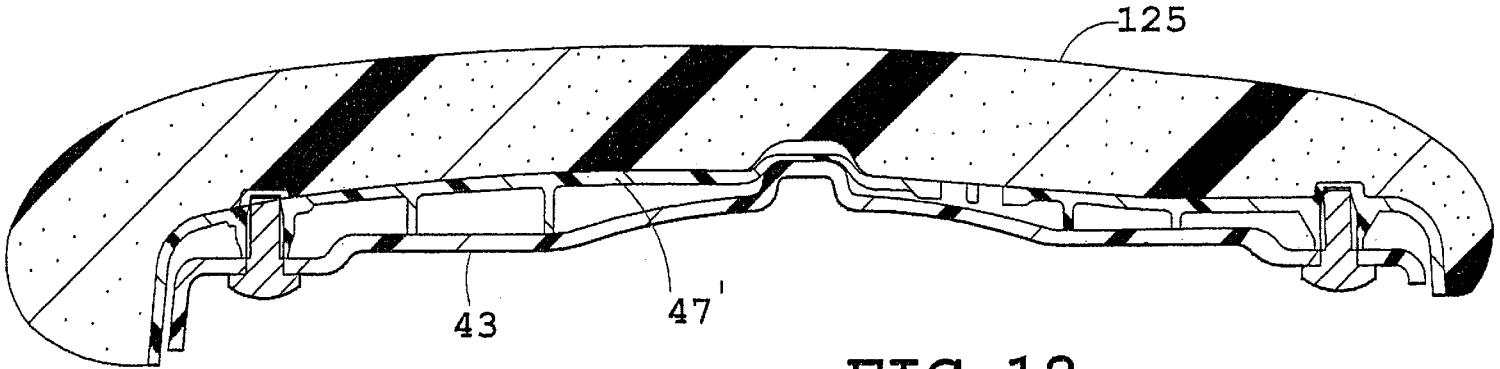

A "FIG. 8" shaped detent/retainer plate 103 is positioned on the gears 39 and 40, and pivot screws 104 and 105 are extended through holes 97_and 98_in the detent/retainer plate 103 and through pivot holes 97 and 98 into apertured pivot-forming bosses 81 and 82. Detent/retainer plate 103 includes an abround embossment 106 that extends around the two holes 97_and 98_in pivot plate 103. The embossment 106 provides an inner concave space for receiving the heads of the screws 104 and 105. Downwardly-extending point embossments 107 and 108 are formed in opposite ends of the detent/retainer plate 103 for mateably engaging the rough bottoms of the channels 99 and 99_. The point embossments 107 and 108 form detents against the channels 99 and 99_and give the arrangement a quality feel. The brake shoe 74 and spacer 80_provide sufficient frictional force to stabilize the armrest against unexpected sliding adjustment when a seated user is using the armrests. Advantageously, the present arrangement provides a frictional force that increases when a person leans on the armrest, thus providing a strong holding force at the most advantageous time, such as when a seated user is leaning on the armrests to rise out of the chair.

The pivot/slide members 44 and 45 (FIG. 3B) each include a lubricous washer 110 for engaging a top of the gears 39 and 40, and further include an apertured upstanding protrusion 111 for mateably rotatably engaging the upstanding pivot-forming bosses 101 and 102. The protrusion 111 includes an outer surface having a square section 112 with flat sides and a round cylindrically-shaped surface 113. The screws 113_secure the gears 39 and 40 to the support plate 43.

The support plate 43 (FIG. 3B) includes a generally planar body having a center section 114 and end sections 115 and 116. The support plate channel 46 for follower 38 is an upwardly-extending embossment formed transversely in center section 114. A pair of recessed areas 117 and 118 are formed at opposite ends of the support plate 43. Upwardly-formed, channel-shaped embossments 119 and 120 are formed in the opposite ends, respectively, and longitudinally-extending slots 121 and 122 are formed in embossments 119 and 120, respectively. The channel-shaped embossments 119 and 120 are shaped to slidably receive the square section 112 of pivot/slide members 44 and 45, and the slots 121 and 122 are shaped to slidably receive the cylindrically-shaped surface 113 of the pivot/slide members 44 and 45. The transverse embossment/channel 46 engages the follower 38 to limit the lateral adjustment of the support plate 43 to a linear motion that is continuously parallel in all positions, while the gears 39 and 40 rotate causing the pivot/slide members 44 and 45 to slide equally along the slots 119 and 120. The armrest body 47 is attached atop the support plate 43 and comprises a relatively flat structural component 47_having recesses 122–124 for mateably engaging and covering the embossments 46, 119, and 120, respectively. A skinned or upholstered cushion 125 is attached atop the support plate 43 by screws, other mechanical fasteners, adhesive, or the like.

A tub-shaped cover 126 (FIG. 3A) fits onto and is attached to the mounting block around the upper end 34 of support 31. Cover 126 includes upwardly-curved sidewalls 127 that extend up and around mounting block 35. An aperture 128 in the sidewalls 127 receives the trigger 62. Apertured bosses 129 are formed inside the cover 126 for receiving screws 130 to retain the cover 126 to the mounting block 35. Reinforcement ribs 131 are formed in cover 126 to help retain its shape. A gear cover 132 (FIG. 3B) is attached atop the gears 39 and 40. Gear cover 132 includes a hollow protrusion 133 for mateably engaging the follower 38 in guide channel 46. The hollow protrusion 133 can be integral with the cover 132 or can be a separate part. A dome-shaped body 134 on the gear cover 132 includes a lip flange 135 that aesthetically covers the gears 39 and 40, even when the armrest is adjusted to its most inwardly position where the gears 39 and 40 extend laterally from under the armrest body 47.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A seating unit comprising:

a seat, and a backrest operably connected with the seat and extending upwardly adjacent said seat;

a support operably connected with at least a selected one of the seat and the backrest and having a mounting block thereon;

an armrest including a pivot block defining a lower surface;

a main pivot mounted on one of the mounting block and the pivot block that pivotally interconnects the mounting block to the pivot block, the main pivot including a pivot hole and the other of the mounting block and the pivot block including a protrusion configured to rotatably engage the hole, the pivot hole and the protrusion including interfacing surfaces having a predetermined high coefficient of friction such that rotation of the armrest about the main pivot requires a predetermined amount of force;

a brake pad separate from the main pivot and located between the mounting block and the pivot block, the brake pad being spaced from the main pivot and contacting the lower surface of the pivot block, whereby the armrest is rotatable about the main pivot, but a predetermined minimum torsional force is required sufficient to overcome a frictional force of the brake pad and of the main pivot to cause rotation of the armrest;

the main pivot including a bushing having an integral spacer positioned between, engaging, and spacing apart the mounting block and the pivot block and contacting the upper surface of the mounting block and also contacting the pivot block to support said pivot block; and wherein:

the interfacing surfaces both have ridges that engage each other to provide a detented frictional force opposing rotation about the main pivot.

2. The seating unit defined in claim 1, wherein:

the protrusion extends downwardly from the pivot block; and the pivot hole is formed in the mounting block.

3. The seating unit defined in claim 1, wherein:

the brake pad is made of a rubber material having a high coefficient of friction.

4. The seating unit defined in claim 1, wherein:

the main pivot defines a pivot axis; and the ridges of the interfacing surfaces extend parallel to the pivot axis.

5. The seating unit defined in claim 1, including:

first and second gears each pivotally mounted on the pivot block, the gears having intermeshing teeth at inner ends adjacent to each other such that rotation of the first gear causes the second gear to simultaneously rotate in an opposite direction, the first and second gears further having outer ends on opposite edges from the inner ends; and a support plate having pivot/slide members engaging the outer ends of the first and second gears; and one of the pivot block and the support plate including a follower, and the other of the pivot block and the support plate including a guide operably engaging the follower to guide lateral movement of the support plate along a predetermined path, the support plate being rotatable about the main pivot to adjust the angular orientation of the armrest construction and being laterally movable along continuously parallel positions to adjust a width of the armrest construction relative to the seating unit.

6. The seating unit defined in claim 5, wherein:

the follower extends upwardly from the pivot block; and the guide is positioned on the support plate.

7. The seating unit defined in claim 6, wherein:

the guide includes a guide channel.

8. The seating unit defined in claim 7, wherein:

the guide channel defines a linear path.

9. The seating unit defined in claim 1, wherein:

at least one of the ridges is formed by an elastomeric material.

10. A seating unit comprising:

a seat and a backrest operably connected with the seat and extending upwardly adjacent the seat;

an armrest support operably connected with at least a selected one of the seat and backrest, the armrest support including a mounting block;

a pivot block pivotally mounted on the mounting block at a main pivot, the pivot block having an upwardly-extending follower;

first and second gears each pivotally mounted on the pivot block, the gears having intermeshing teeth at inner ends adjacent to each other such that rotation of the first gear causes the second gear to simultaneously rotate in an opposite direction, the first and second gears further having outer ends on opposite edges from the inner ends; and a support plate having pivot/slide members engaging the outer ends of the first and second gears, and further having a guide operably engaging the follower to guide lateral movement of the support plate being rotatable about the main pivot to adjust the angular orientation of the armrest construction and being laterally movable along continuously parallel positions to adjust a width of the armrest construction relative to the seating unit.

11. The seating unit defined in claim 10 wherein the guide includes a guide channel.

12. The seating unit defined in claim 11 wherein the guide channel defines a linear path.

13. The seating unit defined in claim 10 including a friction pad on the mounting block engaging the pivot block at a location spaced from the main pivot.

14. The seating unit defined in claim 10 wherein the support plate includes guide slots for guiding the movement of the pivot/slide members.

15. The seating unit defined in claim 14 wherein the gears each include a first end having a gear pivot, and the teeth are spaced from the gear pivot on the first end, and further each includes a second end on which the pivot/slide members are operably mounted.

16. The seating unit defined in claim 10 wherein the mounting block includes a main pivot hole, and the pivot block includes a main pivot bushing member rotatably engaging the main pivot hole, the main pivot hole and the main pivot bushing member having interfacing surfaces defining a relatively high coefficient of friction so that a predetermined force must be applied to the pivot block before the pivot block rotates in the main pivot.

17. The seating unit defined in claim 16 wherein the interfacing surfaces include longitudinally-extending ridges on each of said surfaces that engage each other at incremental positions to provide a detent feel and which hold the armrest body in a selected rotational position relative to the main pivot.

18. The seating unit defined in claim 16 wherein one of the interfacing surfaces includes an elastomeric material for dampening movement in the main pivot.

19. The seating unit defined in claim 10 including an anti-slip, friction-generating material located between the pivot block and the first and second gears.

20. A seating unit comprising:

a seat and a backrest operably connected with the seat and extending upwardly adjacent the seat;

an armrest support operably connected with at least a selected one of the seat and the backrest and including a pivot block having a follower;

first and second gears each pivotally mounted on the pivot block, the gears having intermeshing teeth at inner ends adjacent to each other such that rotation of the first gear causes the second gear to simultaneously rotate in an opposite direction, the first and second gears further having outer ends on opposite edges from the inner ends; and a support plate having pivot/slide members engaging the outer ends of the first and second gears, and further having a guide engaging the follower to guide lateral movement of the support plate along a predetermined path so that the support plate is laterally movable along continuously parallel positions to adjust the width of the armrest construction relative to the seating unit.

21. The seating unit defined in claim 20 wherein the pivot/slide members pivotally engage the first and second gears, and further pivotally and slidably engage the support plate.

22. The seating unit defined in claim 21 wherein the guide comprises a channel-like embossment in the support plate.

23. The seating unit defined in claim 21 including a friction-generating device between the gears and one of the support plate and the pivot block for holding the gears in a selected position.

24. The seating unit defined in claim 23 wherein the first and second gears are pivotally mounted on the pivot block at gear pivots, and wherein the friction-generating device includes an arcuate channel that extends partially around the gear pivots, and further includes a friction plate with point embossments that extend into and engage the arcuate channel.

25. The seating unit defined in claim 23 wherein the friction-generating device includes a brake pad engaging the pivot block.

26. The seating unit defined in claim 21 including a gear cover covering the gears when the first and second gears are in a laterally-adjusted position, such that the first and second gears are covered even when the first and second gears extend partially out from under the support plate.

27. The seating unit defined in claim 20 including an anti-slip, friction-generating material located between the pivot block and the first and second gears.

28. The seating unit defined in claim 20 wherein the armrest support includes a mounting block and the pivot block is pivotally mounted on the mounting block.

29. A seating unit comprising:

a seat and a backrest operably connected with the seat and extending upwardly adjacent the seat;

an armrest support operably connected with at least a selected one of the seat and the backrest and including a mounting block;

a pivot block pivotally mounted on the mounting block at a main pivot;

first and second gears each pivotally mounted on the pivot block, the gears having intermeshing teeth at inner ends adjacent to each other such that rotation of the first gear causes the second gear to simultaneously rotate in an opposite direction, the first and second gears further having outer ends on opposite edges from the inner ends;

a support plate having pivot/slide members engaging the outer ends of the first and second gears, and wherein:

a selected one of said pivot block and said support plate includes a follower, and the other of said pivot block and said support plate includes a guide operably engaging the follower to guide lateral movement of the support plate along a predetermined path, the support plate being rotatable about the main pivot to adjust the angular orientation of the armrest construction and being laterally movable along continuously parallel positions to adjust a width of the armrest construction relative to the seating unit.

30. The seating unit defined in claim 29, wherein:

said follower is located on said mounting block and said guide is part of said support plate.

31. The seating unit defined in claim 30, wherein:

said follower extends upwardly from said pivot block.

32. The seating unit defined in claim 29, wherein the guide includes a guide channel.

33. The seating unit defined in claim 32, wherein the guide channel defines a linear path.

34. The seating unit defined in claim 29 including a friction pad on the mounting block engaging the pivot block at a location spaced from the main pivot.

35. The seating unit defined in claim 29, wherein the support plate includes guide slots for guiding the movement of the pivot/slide members.

36. The seating unit defined in claim 35, wherein the gears each include a first end having a gear pivot, and the teeth are spaced from the gear pivot on the first end, and further each includes a second end on which the pivot/slide members are operably mounted.

37. The seating unit defined in claim 29, wherein the mounting block includes a main pivot hole, and the pivot block includes a main pivot busing member rotatably engaging the main pivot hole, the main pivot hole and the main pivot bushing member having interfacing surfaces defining a relatively high coefficient of friction so that a predetermined force must be applied to the pivot block before the pivot block rotates in the main pivot.

38. The seating unit defined in claim 37, wherein the interfacing surfaces include longitudinally-extending ridges on each of said surfaces that engage each other at incremental positions to provide a detent feel and which hold the armrest body in a selected rotational position relative to the main pivot.

39. The seating unit defined in claim 37, wherein at least one of the interfacing surfaces includes an elastomeric material for dampening movement in the main pivot.

40. The seating unit defined in claim 29 including an anti-slip, friction-generating material located between the pivot block and the first and second gears.

41. A seating unit comprising:

a seat and a backrest operably connected with the seat and extending upwardly adjacent the seat;

an armrest support operably connected with at least a selected one of the seat and the backrest and including a pivot block;

first and second gears each pivotally mounted on the pivot block, the gears having intermeshing teeth at inner ends adjacent to each other such that rotation of the first gear causes the second gear to simultaneously rotate in an opposite direction, the first and second gears further having outer ends on opposite edges from the inner ends;

a support plate having pivot/slide members engaging the outer ends of the first and second gears, and wherein:

a selected one of said pivot block and said support plate includes a follower, and the other of said pivot block and said support plate includes a guide engaging the follower to guide lateral movement of the support plate along a predetermined path so that the support plate is laterally movable along continuously parallel positions to adjust a width of the armrest construction relative to the seating unit.

42. The seating unit defined in claim 41, wherein the pivot/slide members pivotally engage the first and second gears, and further pivotally and slidably engage the support plate.

43. The seating unit defined in claim 42, wherein the guide comprises a channel-like embossment in the support plate.

44. The seating unit defined in claim 42, including a friction-generating device between the gears and one of the support plate and the pivot block for holding the gears in a selected position.

45. The seating unit defined in claim 44, wherein the first and second gears are pivotally mounted on the pivot block at gear pivots, and wherein the friction-generating device includes an arcuate channel that extends partially around the gear pivots, and further includes a friction plate with point embossments that extend into and engage the arcuate channel.

46. The seating unit defined in claim 44, wherein the friction-generating device includes a brake pad engaging the pivot block.

47. The seating unit defined in claim 42, including a gear cover covering the gears when the first and second gears are in a laterally-adjusted position, such that the first and second gears are covered even when the first and second gears extend partially out from under the support plate.

48. The seating unit defined in claim 41, including an anti-slip, friction-generating material located between the pivot block and the first and second gears.

49. The seating unit defined in claim 41, wherein the armrest support includes a mounting block and the pivot block is pivotally mounted on the mounting block.

* * * * *

UNITED STATES PATENT AND TRADEMARK OFFICE

CERTIFICATE OF CORRECTION

PATENT NO. : 6,302,486 B1
DATED : October 16, 2001
INVENTOR(S) : Michel A. Lamart et al.

Figure 3B:
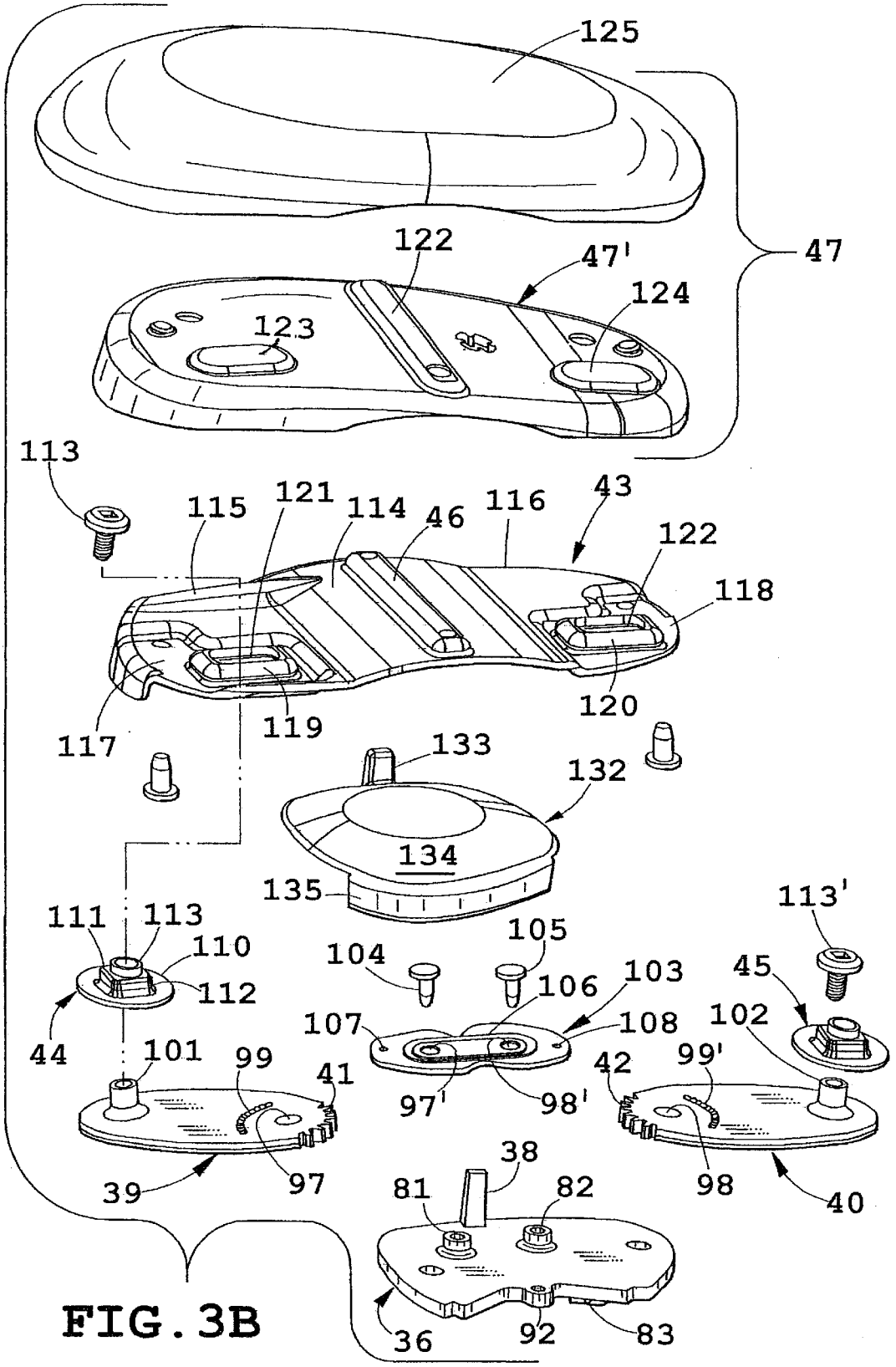

It is certified that error appears in the above-identified patent and that said Letters Patent is hereby corrected as shown below:

Column 2,
Line 56, "Fig. 3A and 3B" should be -- Figs. 3A and 3B --;
Line 59, "Fig. 4-6" should be -- Figs. 4-6 --;
Line 60, after "armrest" insert -- body --;

Column 3,
Line 1, "Fig. 9-12" should be -- Figs. 9-12 --.

Signed and Sealed this

Fourth Day of June, 2002

*Attest:*

*Attesting Officer*

JAMES E. ROGAN
*Director of the United States Patent and Trademark Office*